United States Patent [19]

Resch

[11] 4,059,932

[45] Nov. 29, 1977

[54] SELF-SUPPORTING STRUCTURAL UNIT HAVING A THREE-DIMENSIONAL SURFACE

[76] Inventor: Ronald Dale Resch, 1257 2nd Ave., Salt Lake City, Utah 84103

[21] Appl. No.: 697,701

[22] Filed: June 21, 1976

[51] Int. Cl.[2] ..... E04B 1/32

[52] U.S. Cl. ..... 52/81

[58] Field of Search ..... 52/80, 81, DIG. 10, 52/615

[56] References Cited

U.S. PATENT DOCUMENTS

| | | | |
|---|---|---|---|
| 2,905,113 | 9/1959 | Fuller | 52/81 |
| 3,063,521 | 11/1962 | Fuller | 52/81 |
| 3,133,133 | 5/1964 | Fairbanks | 52/80 |
| 3,184,094 | 5/1965 | French | 52/630 |
| 3,201,894 | 8/1965 | Resch | 52/DIG. 10 |
| 3,325,958 | 6/1967 | Moore | 52/81 |
| 3,407,558 | 10/1968 | Resch | 52/80 |
| 3,501,367 | 3/1970 | Parker | 52/615 |

FOREIGN PATENT DOCUMENTS

| | | | |
|---|---|---|---|
| 1,454,527 | 10/1966 | France | 52/80 |
| 789,499 | 10/1935 | France | 52/81 |

OTHER PUBLICATIONS

Mathematical Models by Cundy & Rollett, Oxford University Press, © 1961, pp. 59–63.

Domebook II, © 1971 pp. 28, 26, 35, 36.

*Primary Examiner*—Price C. Faw, Jr.

*Assistant Examiner*—Henry Raduazo

*Attorney, Agent, or Firm*—Alexander T. Kardos

[57] ABSTRACT

A self-supporting structural unit having a three-dimensional surface comprising: a first plurality of identical polygons, such as, for example, equilateral triangles, having predefined, fixed areas and equal sides of a predetermined constant length: and a second plurality of polygons, such as, for example, hexagons, having various areas but with equal sides of a predetermined constant length, the sides of the first plurality of polygons being equal in length to the sides of the second plurality of polygons and being secured thereto and in coextensive alignment therewith, the vertices of the first plurality of identical polygons and the second plurality of polygons lying substantially in the three-dimensional surface of the self-supporting structural unit.

13 Claims, 13 Drawing Figures

FIG. 1
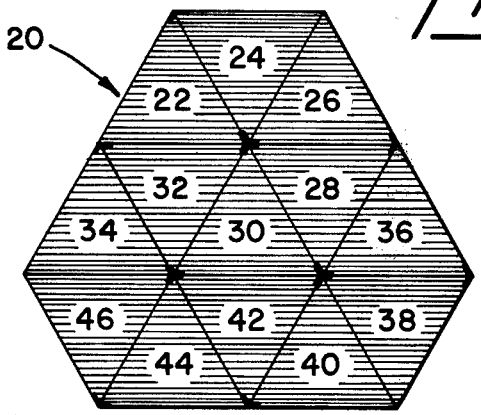
FIG. 2
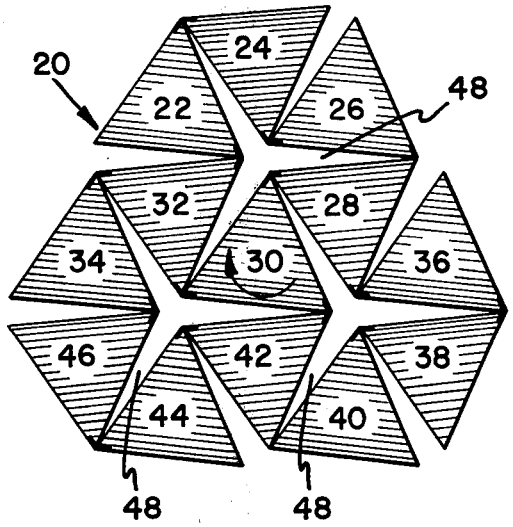
FIG. 3
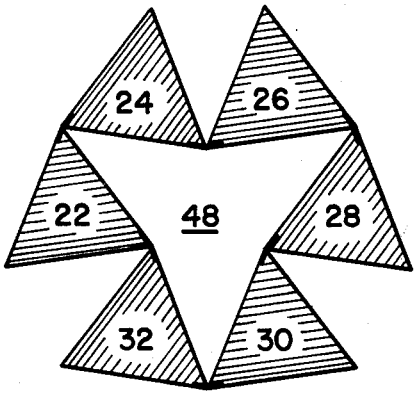
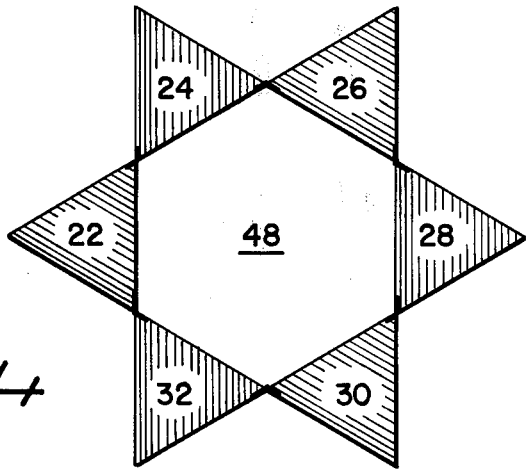
FIG. 4

FIG. 8
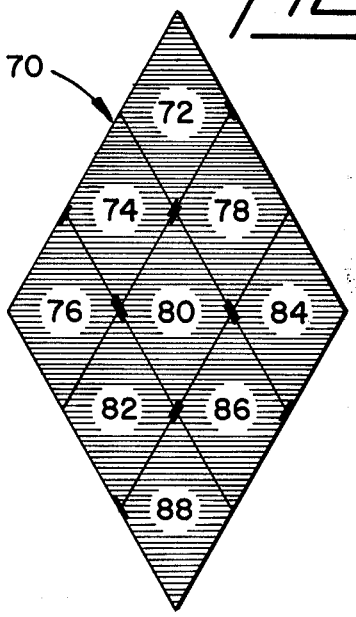
FIG. 9
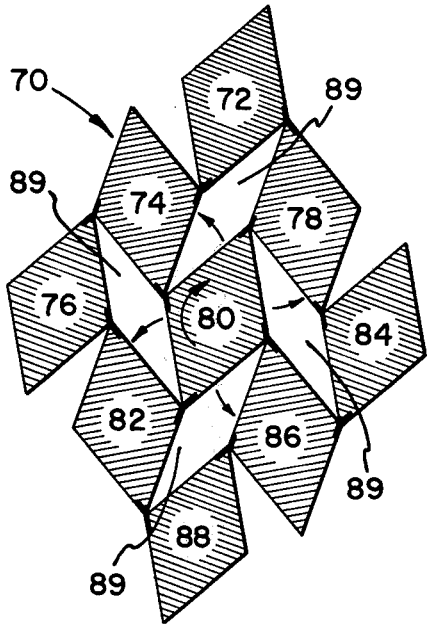
FIG. 10
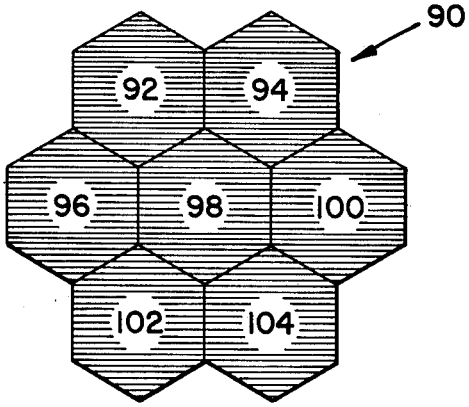
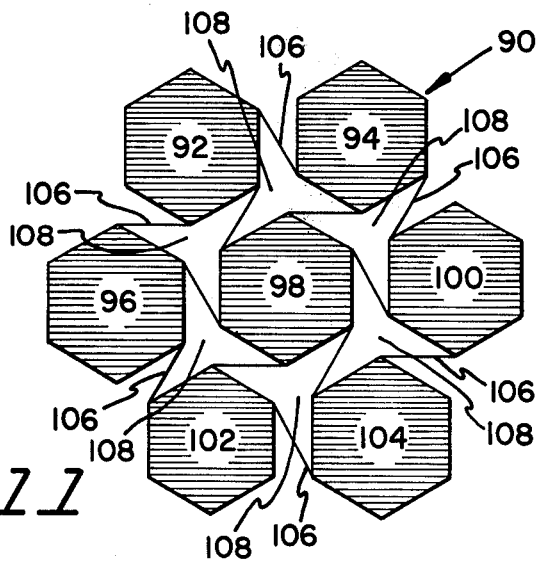
FIG. 11

SELF-SUPPORTING STRUCTURAL UNIT HAVING A THREE-DIMENSIONAL SURFACE

THE FIELD OF THE INVENTION

The present invention relates to self-supporting structural units having a three-dimensional surface and, more particularly, is concerned with such self-supporting structural units of use as the outer covering or shell of structures such as buildings, edifices, monuments, ornamental displays, athletic field houses, ships hulls, dirigibles, aircraft hangars, railroad and bus terminals, athletic event stadia, dams, water towers, etc. Additionally, the self-supporting structural units are useful as interior surfaces or ceilings, such as acoustical or sound deadening surfaces, decorative or ornamental walls or displays, lighting equipment and fixtures including reflectors, displays, panels, and the like, baffles, etc. Also, such self-supporting structural units may be used as the framework or the formwork of such structures in foam, plastics, concrete, etc., or the overlay of reinforced ceramic or plastic materials.

THE BACKGROUND OF THE INVENTION

Self-supporting structural units having a three-dimensional surface have been used for thousands of years to enclose space for various specified purposes and activities, the most familiar form of such self-supporting structural units being a building designed and constructed to stand more or less permanently, and covering an area of land, for use as a dwelling, an office building, a warehouse, an enclosure for the holding of public or governmental functions, or for other useful purposes and activities.

When such self-supporting structural units are regular or are conventional in conformation or are developable in configuration, such as a cube, or a prism, or a cylinder, or a cone, or truncated portions of such units, etc., the design, fabrication and the construction of such units is relatively simple and uncomplicated.

However, when it is desired that such self-supporting structural units be irregular or non-conventional in conformation, or are non-developable in configuration, the design, fabrication and the construction thereof is not quite as simple or uncomplicated.

One such type of building construction for making a non-developable three-dimensional surface is noted in U.S. Pat. No. 2,682,235 which issued on June 29, 1954 and which relates to a building framework of somewhat generally hemi-spherical form. Such type of building framework has been used in commerce and industry but its applicability is limited severely by the fact that its basic principles are suitable only for buildings of a generally hemi-spherical or like shape, which is merely one form of a non-developable three-dimensional surface.

For example, its basic principles are not applicable to three-dimensional shapes which are ellipsoidal, ovaloidal, paraboloidal, elliptic paraboloidal, hyperboloidal, hyperbolic paraboloidal, regular or irregular surfaces of revolution, ruled surfaces, and various other three-dimensional surfaces which have many and varied interesting and unusual applications. And, its principles are similarly not applicable to shapes which are more or less irregular in curvature or conformation, such as, for example, the hull of a ship.

Other self-supporting structural units or other geometrical configurations having three-dimensional surfaces are disclosed in my earlier U.S. Pat. No. 3,407,558 which issued on Oct. 29, 1968. However, there is always a need for continued improvement and for further development in such a field.

PURPOSES AND OBJECTS OF THE INVENTION

It is therefore a principal purpose and object of the present invention to provide a self-supporting structural unit having a three-dimensional surface which is universally applicable to substantially any shape, regardless of whether it is developable or not, regular or irregular, or otherwise beyond the scope and the ability of presently known techniques and skills.

BRIEF SUMMARY OF THE INVENTION

It has been found that such principal purpose and object of the present invention, as well as other principal purposes and objects which will become clearer from a further reading and better understanding of the invention, are achieved by providing a self-supporting structural unit having a three-dimensional surface comprising: a first plurality of identical polygons, such, as for example, equilateral triangles, having predefined and fixed areas and equal sides of a predetermined constant length; and a second plurality of polygons, such as, for example, hexagons, having various areas but with equal sides of a predetermined constant, unchanging length, the sides of the first plurality of identical polygons being equal in length to the sides of the second plurality of polygons and being secured thereto and in side-by-side mutual coextensive alignment therewith, the vertices of the plurality of identical polygons and the vertices of the second plurality of polygons lying substantially in the three-dimensional surface of the self-supporting structural unit.

BRIEF DESCRIPTION OF THE DRAWINGS

In the following specification and accompanying self-explanatory drawings, there are described and illustrated typical and preferred embodiments of the present invention but it is to be understood that the broader aspects of the invention are not to be construed as limited to such typical and preferred embodiments, as are disclosed specifically, except as defined and determined by the scope and the spirit of the appended claims.

Referring to the accompanying drawings:

FIG. 1 is a simplified, diagrammatic plan view of a geometric device of use in applying the principles of the present invention, showing the arrangement of the polygonal sections which are in the form of identical equilateral triangles, with the geometric device in the so-called closed position;

FIG. 2 is a simplified, diagrammatic plan view of the geometric device of FIG. 1, showing the arrangement of the polygonal sections in an intermediate position between the closed position of FIG. 1 and the fully opened position;

FIG. 3 is a simplified, diagrammatic plan niew of a portion of the geometric device of FIG. 1, showing the arrangement of the polygonal sections in another intermediate position between the partially open position of FIG. 2 and the fully opened position;

FIG. 4 is a simplified, diagrammatic plan view of a portion of the geometric device of FIG. 1, showing the arrangement of the polygonal sections in the fully opened position;

FIG. 8 is a simplified, diagrammatic plan view of still another geometric device of use in applying the principles of the present invention, wherein the polygonal sections are in the form of rhombuses, with the geometric device in the closed position;

FIG. 9 is a simplified, diagrammatic plan view of the geometric device of FIG. 8, showing the arrangement of the polygonal sections in a partially open position;

FIG. 10 is a simplified, diagrammatic plan view of a portion of a still another geometric device of use in applying the principles of the present invention, wherein the polygonal sections are in the form of equilateral, equiangular hexagons, with the geometric device in the closed position;

FIG. 11 is a simplified, diagrammatic plan view of the geometric device of FIG. 10, showing the arrangement of the polygonal sections as hexagons, with the geometric device in the partially opened position and also showing the use of special bar linkages which act as hinges in the rotation of the hexagonal sections;

DESCRIPTION OF A TYPICAL PREFERRED EMBODIMENT

Figure 5:
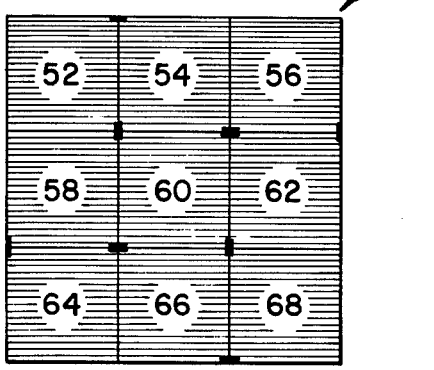
FIG. 5 is a simplified, diagrammatic plan view of another geometric device of use in applying the principles of the present invention, wherein the polygonal sections are in the form of squares and the geometric device is in the closed position.

With specific reference to FIG. 1 of the drawings, there is shown a portion of a geometric device 20, such as illustrated in U.S. Pat. No. 3,201,894 which issued Aug. 24, 1965 and which is incorporated herein by reference thereto for a more specific description and operation of geometric device 20 and other geometric devices to be referred to hereinafter.

The portion of the geometric device 20 shown in the drawings comprises a plurality of identical polygons, in this case, equilateral triangles 22, 24, 26, 28, 30, 32, 34, 36, 38, 40, 42, 44, and 46. These triangles 22 to 46 are similar or identical triangles, that is, they are all equilateral and equiangular, having sides which are equal and have a predetermined constant unvarying length and a predetermined constant area.

The identical triangles 22 to 46 represent only a small fraction of the complete geometric device to be used in applying the principles of the present invention and may be generally termed as a module or a unit of such a complete geometric device, in that there are many more identical triangles which are similarly shaped and interrelated. The identical triangles 22 to 46, and other polygons to be described hereinafter, are hinged at certain of their vertices, either as described in said U.S. Pat. No. 3,201,894, or by bars or other equivalent linkages which extend from a vertex on one polygon to a vertex on another polygon. However, such hinges, bars, or other linkages do not relate to the essence of the present invention, and other equivalent means or manner of interlocking or interrelating the rotational movement of the various polygons may be employed.

As a result of such hinges or linkages, the triangles 22 to 46 are adapted to be rotated, as is described in the above mentioned patent, and the geometric device 20 can be expanded into the configuration shown in FIG. 2. In this Figure, the individual triangles 22 to 46 have been rotated and the portion of the geometric device 20 has been expanded out of the closed position of FIG. 1 and is partly opened and the triangles 22 to 46 are angularly separated from one another by three-cornered, three-legged, star-shaped, six-sided polygons, in this case, hexagons 48.

The hexagons 48 are initially relatively very thin, very sharply or acutely pointed, three-cornered, three-legged, star-shaped polygons, as the rotation and expansion procedure gets under way. However, as the rotation and expansion procedure continues, the sides of the three legs of the star-shaped polygons diverge more widely and the legs become less sharply or acutely pointed, as illustrated in FIG. 3.

FIG. 3, for simplicity purposes, shows only six triangles 22 to 32 and one centrally located star-shaped hexagon 48, although it is to be appreciated that there are many more triangles and hexagons in the complete geometric device. As the rotation and expansion procedures continues, the sides of the triangles remain the same and are constant, with their areas also remaining constant and fixed. The sides of the hexagon 48 also remain constant but they vary in their angular relationship to each other whereby the area enclosed by the six sides of the hexagon 48 increases until it finally reaches a configuration of maximum area, as shown in FIG. 4, after which, if rotation were to be continued, the area of the hexagon would decrease.

It is therefore to be realized that the area of the hexagon 48 is initially zero, as in the closed position of FIG. 1; that it increases through an infinite number steps as the rotation and the expansion procedure takes place to a maximum size area, as shown in the completely opened position of FIG. 4 and then, if it were to be desired or required, to contract through an infinite number of decreases in area back to an area of zero.

During such rotational movements, as described thus far, all the identical triangles have been uniformly rotated through the same degree of angularity, whereby the three legs of the hexagon 48 have been changed substantially evenly and uniformly in the angularity of their sides and in their areas. It is not necessary that all the identical triangles rotate simultaneously, evenly or uniformly throughout the same degree of angularity. Some may be rotated more and some may be rotated less. As a result, even though three-cornered, three-legged, star-shaped, six-sided polygons 48 are always formed as before, the shape, angularity, and the areas of the individual legs need not necessarily be the same, even within the same polygon 48. This therefore provides for an even greater variety of shapes, angularities, and areas to the polygons 48 and to the geometric device 20. This tremendous range of possibilities as regards shapes, angles, and areas accounts for the ability of the geometric device 20 to adjust universally to substantially any type or form of curved surface.

It is also to be noted that, during such rotational movements, the individual star-shaped hexagons 48 have three legs, each of which is a isosceles triangle, wherein the two long sides which are equal are formed by two sides of adjacent, hinged equilateral identical triangles. As a consequence of this relationship, it is realized that the individual hexagons 48 have six sides, all of them being individually equal in length to the individual sides of the equilateral identical triangles 22 to 46. The purpose and use of such equilateral hexagons 48 having sides equal to the sides of the equilateral identical triangles 22 to 46 will become clearer from a further reading and better understanding of this specification.

The geometric device 20 shown in FIGS. 1–4 and especially FIG. 2 best demonstrates the relationship between the fixed-area equilateral identical triangles 22 to 46 and the varying area equilateral star-shaped hexagons 48 and will be employed to further describe the present invention. Also, it must be realized that the complete geometric device employed in further describing the present invention is not to be considered as merely comprising the fixed area identical triangles 22 to 46 and the varying-area star-shaped hexagons 48 but that it also includes many other fixed-area identical triangles and many other varying-area star-shaped hexagons which are hingedly arranged around the periphery of the illustrated identical triangles 22 to 46 and the star-shaped hexagons 48. As a consequence, the total area covered by the complete geometric device is many times the area covered by the illustrated geometric device 20.

USE OF THE COMPLETE GEOMETRIC DEVICE

The complete geometric device employing the identical equilateral triangles as their basic units is used in the designing and the fabricating of the self-supporting structural unit having the desired three-dimensional surface in the following manner. The complete geometric device is made up to a specified, small-scale size and is placed in contact with the concave surface of a model made up to the same specified, small scale size of the desired three-dimensional surface. It is to be appreciated that the equilateral identical triangles can easily be rotated and shifted in various ways and that the complete geometric device can easily be expanded whereby the varying-area star-shaped hexagons can assume an infinite number of angular configurations and relationships and areas so that the entire concave surface of the small scale model can be completely covered by the complete geometric device.

At the same time, the vertices of the identical equilateral triangles which are hingedly interconnected are not that rigidly interrelated that the hinges cannot yield to the very small degree that is required so that all these vertices contact and lie on the concave surface of the small scale model of the larger three-dimensional surface to be subsequently fabricated and constructed. Naturally, the smaller is the size of the individual equilateral identical triangles with respect to the size of the model concave surface against which they are being fitted, then the closer you will approximately fit the concave surface of the small scale model. This is, of course, analogous to the use of a very large number of chords used to inscribe the circumference of a circle or arc.

Having so positioned the geometric device and carefully adjusted the identical triangles and equilateral hexagons thereof, a careful and precise note is taken of the positioning, spacing and the angularity of such polygons and particularly the equilateral hexagons. Measurements are precisely taken and are then scaled upwardly in order to obtain the proper size of the triangles and hexagons to be used in the full size fabricated surface. With such measurements, the necessary triangular and hexagonal elements are fabricated accordingly and are ready for assembling.

The full scale equilateral triangles and equilateral hexagons are then assembled on the site where the self-supporting structural unit is to be built. Such assembly takes place, piece by piece, by welding, bolting, clamping, adhesively securing, or otherwise joining the pieces together with equal sides in mutual coextensive alignment in accordance with the positioning, spacing, and the angularity observed and recorded in the small size scale model. This is a relatively simple matter when it is realized that the sides of the triangles and the sides of the hexagons are the same in length. Therefore, their joining together in coextensive alignment does not require any special fabrication equipment which would be required if such sides were not exactly equal. This is a very advantageous feature of the present invention and makes the construction at the site a relatively simple matter.

When constructed, the three-cornered, three-legged, star-shaped equilateral hexagons 48 often assume or are actually deliberately given a slight bend or crease at the lines of intersection between the three legs and the centrally located triangular portion which is, in a way, shared by all three legs. As a result, in some cases, the hexagons 48 assume the visual appearance of being four triangles that is, three spire shaped triangles and a fourth central triangle with common borders. Such an effect is especially notable in the illustrated embodiment of FIG. 13.

The various polygons of the self-supporting structural unit may be made of any desired structural material, depending upon the needs and the requirements or desires of the particular circumstances. Metallic elements such as aluminum, magnesium, steel, galvanized iron, and so forth; alloys such as duralumin (dural), bronze, monel, etc., are satisfactory. Plastic materials, wood or wood products, plywood, built-up layered sections, concrete, ceramics, and the like are also of use.

The polygons may be solid or hollow or perforated, or they may merely comprise frames with plastic or glass inserts which may be translucent, transparent, or opaque. The thicknesses of the polygons will depend upon the specific material being used, its strength and rigidity, the demands and the requirements of the particular situation, the size of the polygons being used and the size of the three-dimensional surface being constructed, etc. Thicknesses of some metallic materials as thin as about 1/16 inch or ⅛ inch are often satisfactory, whereas for some other materials having lesser strengths, thicknesses of as much as an inch or two inches or even more are required in some cases.

OTHER TYPICAL EMBODIMENTS OF THE INVENTION

It is not essential that equilateral identical triangles always be used or that three-cornered, three-legged, star-shaped hexagons always be subsequently formed during the rotation and expansion operation in order to carry out the principles of the present invention. Other equilateral polygons may be initially used and be rotated; and polygons of other shapes and numbers of sides may be subsequently formed. Such other embodiments of the present invention will now be described.

Figure 6:
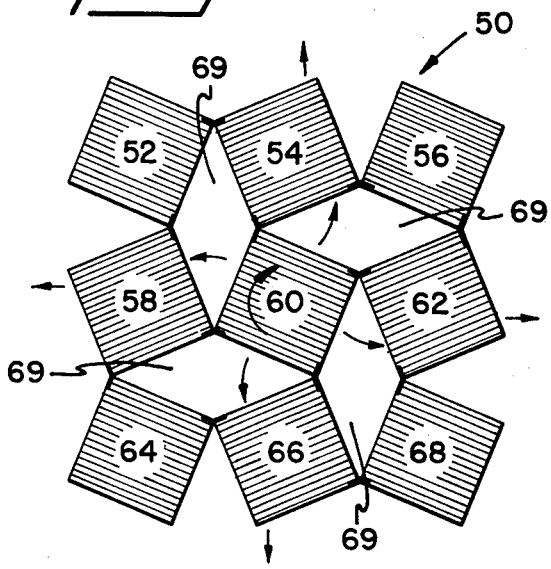
FIG. 6 is a simplified, diagrammatic plan view of the geometric device of FIG. 5, showing the arrangement of the squares in a partially opened position.
Figure 7:
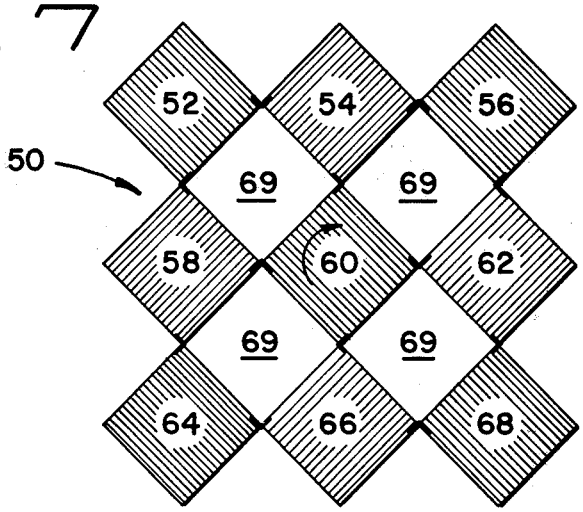
FIG. 7 is a simplified, diagrammatic plan view of the geometric device of FIG. 5, showing the arrangement of the squares in the fully opened position.

FIGS. 5, 6 and 7 disclose another typical embodiment of the present invention employing a geometric device 50 comprising a plurality of quadrilaterals, or more specifically, squares 52, 54, 56, 58, 60, 62, 64, 66 and 68 which can be used and rotated as described hereinbefore in order to obtain the same or comparable results. In this instance, polygons are formed during the rotation of the squares 52 to 68 and the expansion of the geometric device 50 which are rhombuses, as noted in FIG. 6, which rhombuses ultimately reach a maximum opened configuration of squares at the moment of maximum opening of the geometric device 50 and maximum area of the created polygons 69, as noted in FIG. 7.

It is also to be observed that the squares 52 to 68 have a constant and fixed and unvarying area, with all four sides remaining equal and constant at all times, and with their interior similarly being equal and unchanging at all times. The rhombuses 69 which are formed during the rotation, however, have a zero area at the outset of the rotation; then form what may be termed two-legged, diamond-shaped, rhomboidal polygons 69 having four equal sides. As the rotation and expansion operation continues, the sides of the two legs of the relatively thin polygons or rhombuses 69 diverge angularly from each other to a greater degree and the areas of the legs and of the rhombuses 69 increases. But, at all times, the lengths of the sides of the two legs remains constant and equal to each other and also equal to the length of the sides of the squares 52 to 68. In this way, as pointed out previously herein, the squares 52 to 68 and the rhombuses 69 can subsequently be brought together in coextensive alignment and secured together with a minimum of adjustment.

It is again to be observed that the squares 52 to 68 are merely illustrative of a part or a unit or module from which the complete geometric device is formed, with many additional squares hingedly secured and arranged around the periphery of the squares 52 to 68, forming a complete geometric device of a much greater size.

The complete geometric device is then constructed to a specified small scale size as before and is used in conjunction with the model of the surface to be ultimately built. The positioning and spacing of the small scale geometric device on the concave surface of the small scale three-dimensional surface, and the precise locations and angularities of the squares and rhombuses is then carefully measured, as before. The measurements are then scaled upwardly accordingly and the large scale or full scale elements are then fabricated. Assembly and construction of the full scale self-supporting structural unit with the three-dimensional surface then proceeds on the construction site.

FIGS. 8 and 9 disclose another embodiment of the present invention which employs a geometric device 70 comprising rhombuses 72, 74, 76, 78, 80, 82, 84, 86 and 88 which can be used to achieve the same or comparable results as the previously described geometric devices. It is to be observed that the polygons 89 which are formed by the rotation of the rhombuses 72 to 88 and the expansion of the geometric device 70 are rhombuses but that, at only one time during the rotation and expansion procedure, when the interior angles of the polygons 89 become equal as right angles, they become squares.

The rhombuses 72 to 88 have a constant and fixed, unvarying area, with all sides equal and of a constant unvarying length, with their interior also being constant, unchanging and fixed. The polygons 89 which are created during the rotation and expansion have an initial area of zero, as illustrated in the FIG. 8, and then form what may be termed two-legged, star-shaped, or diamond-shaped rhomboidal polygons having four sides. As the rotation and the expansion continues, the sides of the legs of the polygons 89 diverge angularly to a greater and greater degree whereby the areas of the legs and the polygons 89 increase accordingly. But, again, at all times, the length of the sides of the polygons 89 are equal to each other and to the lengths of the sides of the rhombuses 72 to 88, whereby they can be subsequently joined and secured together in mutual coextensive alignment in a fashion similar to that which has been described previously herein.

The rhombuses 72 to 88 are merely illustrative of a portion or part or unit or module from which the complete geometric unit or device is formed, having many additional rhombuses hingedly arranged around the periphery of the rhombuses 72 to 88. The complete geometric device is reproduced in relatively small scale size and is used in conjunction with a model of the self-supporting structural unit scaled down to a corresponding small size. The measurements are taken carefully and precisely, as described previously; then scaled upwardly to provide for the making of the structural elements in the proper full scale size for the construction of the full scale self-supporting structural unit.

FIGS. 10 and 11 describe still another embodiment of the present invention, employing a geometric device 90 which comprises hexagons 92, 94, 96, 98, 100, 102 and 104 which can be used to achieve the same or comparable results as was achieved previously by the geometric devices described hereinbefore. The construction and operation of the geometric device is basically the same as set forth previously except that, as noted in FIG. 11, the hexagons are hinged together by hinge bars 106 which extend from the vertex of one hexagon to a vertex of an adjacent hexagon. These hinge bars may be made of any suitably strong material such a metal as aluminum, magnesium, steel, etc., or an alloy such as duralumin, brass, bronze, monel, etc. They are, of course, rigid members and have the same length as the lengths of the sides of the hexagons which are regular, equilateral and equiangular and possess areas which remain fixed and unvarying throughout the rotation and the expansion operation.

Three-cornered, three-legged, star-shaped hexagons 108 are formed during the rotation of the hexagons 92 to 104 and the expansion of the geometric device 90 which are bounded by three sides of adjacent hexagons and by three lengths of hinge bars 106 which alternate with each other, as shown. Inasmuch as all these sides and lengths are equal, the resulting hexagons 108 are equilateral, but of different areas and of different angularities. As the rotation and expansion operation continues, the areas of the hexagons 108 increases from a value of zero, such as would exist in the closed condition illustrated in FIG. 10, to greater values as the rotation of expansion continues. It is to be noted that, at one moment in the rotation and expansion, the hexagons 108 become triangles, when the hinge bars 106 align themselves with the sides of the respective hexagons.

The hexagons 92–104 are merely illustrative of a portion or a part of the larger complete geometric device, having additional hexagons hingedly arranged around the periphery of the hexagons 92 to 104. The complete geometric device is reproduced in a small scale, as usual, and is used in conjunction with a similarly small-scaled model of the three-dimensional surface to be ultimately built. The geometric device is placed against the concave surface, as usual, and the required measurements are taken accurately and carefully. These are then scaled upwardly and the full scale elements are fabricated accordingly. The elements are then assembled at the construction site and the building of the structural unit proceeds, as described previously.

The sides of the equilateral, equiangular identical hexagons 92 to 104 are equal to the sides of the three-cornered, three-legged, star-shaped hexagons 108 and these elements are easily brought together into mutual coextensive alignment and are secured together. The construction is generally similar to the construction of the three-dimensional surfaces previously described.

SPECIFIC APPLICATIONS OF THE INVENTION

Figure 12:
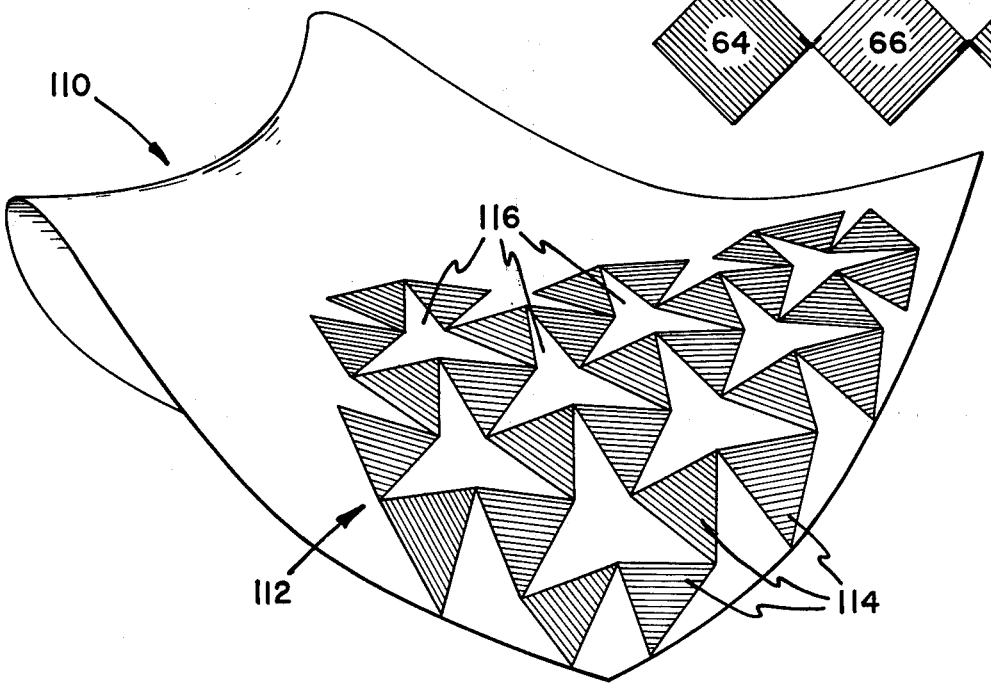
FIG. 12 is a simplified, diagrammatic, fragmentary perspective view of a hyperbolic paraboloidal curved surface, showing the arrangement of the polygonal sections of the geometric device, such as shown in FIGS. 1–4, on a portion of the curved surface thereof.

FIG. 12 illustrates the application of the principles of the present invention to the formation of a curved, three-dimensional quadric surface such as a hyperbolic paraboloidal surface 110, which possesses the following generic analytical geometric equation:

$$(x^2/a^2) - (y^2/b^2) = 2\,cz$$

The curved three-dimensional surface 110 resulting from such an equation is non-developable and is often more popularly compared to the curved surface of a deep saddle. A portion of a geometric device 112 is shown comprising identical equilateral, equiangular triangles 114 having a constant and fixed, unvarying area and sides. Upon rotation of these triangles 114, there is created a plurality of three-cornered, three-legged, star-shaped hexagons 116 of various sizes and shapes of areas and different angularities of the three leg portions, but always with the sides thereof constant and fixed and unvarying in length and always equal to the sides of the indentical triangles 114.

The vertices of the identical triangles 114 and the vertices of the hexagons 116 contact and lie in the surface of the curved three-dimensional hyperbolic paraboloid 110. Again, it is to be observed that the lengths of the sides of the triangles and the hexagons are the same, regardless of the extent of the rotation and expansion. Such provides for an easy and simple construction of the full scale elements at the construction site at a later time.

Measurements of the positioning and the angularities of the various triangles and hexagons of the small geometric device as placed on the small scale model of the hyperbolic paraboloid 110 and these are scaled upwardly and the full scale elements are fabricated from such upwardly-scaled values. The full scale elements comprising triangles and hexagons are taken to the construction site and are assembled thereat into the desired full scale curved surface.

Figure 13:
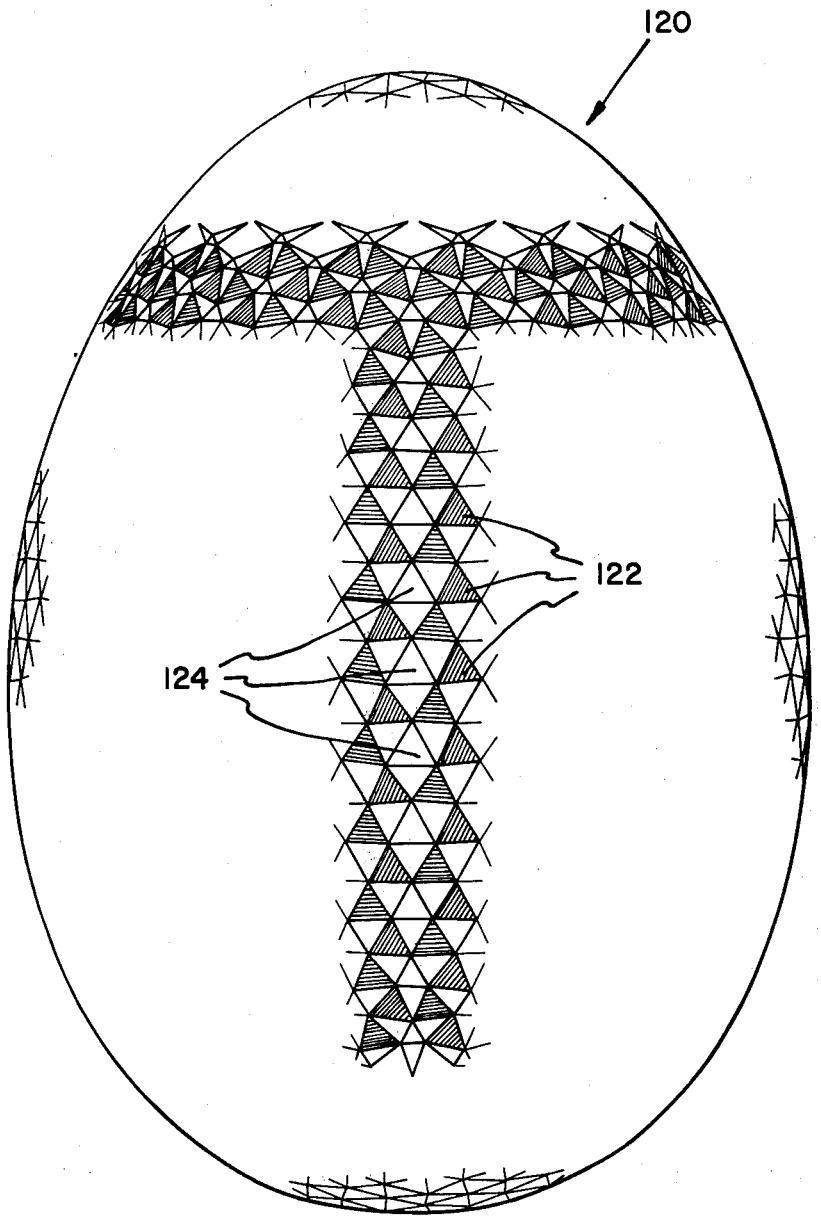
FIG. 13 is a simplified, diagrammatic view in elevation of an egg-shaped surface, showing the arrangement of the polygonal sections of the geometric device of FIGS. 1–4 on a portion of the surface thereof.

FIG. 13 illustrates still another application of the principles of the present invention, this time to the formation of an egg-shaped solid. The surface of such a solid is not developable; does not conform to any standard conventional definition; and cannot be defined satisfactorily or easily by any generic analytical geometric equation as was the hyperbolic paraboloid. It is the type of a three-dimensional surface which defies standard or conventional treatment.

Nevertheless, such an egg-shaped solid 120 can be designed, fabricated, and constructed according to the principles of the present invention by the use of a complete geometric device, such as illustrated in FIGS. 1–4, employing identical equilateral triangles 122 which, upon rotation and concomitant expansion of the geometric device, create three-cornered, three-legged, star-shaped hexagons 124.

The complete geometric device is laid out on the concave, inside surface of the small scale model in the usual way and all the measurements are taken on the small scale geometric device. The positioning and the angularities of the triangles and hexagons is measured very accurately and is then scaled upwardly to yield the figures and the values for the full scale triangles and hexagons. These are then fabricated in full scale and taken to the construction site and are ready for the assembly and building process.

Again, it is to be observed that the equilateral identical triangles are equal and of the same areas and lengths of sides, whereas the three-cornered, three-legged, star-shaped hexagons 124 have sides which are all of the same length and equal to the lengths of the sides of the identical equilateral triangles 122. However, the areas of the hexagons initially have values of zero before the rotation and expansion but, as shown in FIG. 13, have definite positive values which vary widely, depending upon the extent of the rotation and expansion. In this respect, it is interesting to note that the expansion of the elements is greatest in the center part of the egg and that it therefore follows that the hexagons 124 are greatest in area thereat.

The present invention will be further described with particular reference to the following specific Examples, wherein there are disclosed typical and preferred embodiments of the present inventive concept. However, it is to be stated that such specific Examples are primarily illustrative of the present invention and that they are not to be construed as limitative of the broader aspects of the invention, except as defined and determined by the scope and the spirit of the appended claims.

EXAMPLE I

An egg-shaped solid, such as illustrated in FIG. 13, is made as follows: first, primarily for ease of handling for fabrication and construction purposes, the egg is considered as having three parts: a central portion somewhat resembling a barrel-like cylinder with bulging sides; and an end portion which is slightly larger and more rounded; and another end portion which is slightly smaller and less rounded.

The central portion is prepared from a complete geometric device comprising identical equilateral triangles having sides of about one foot each. This geometric device is expanded and formed into the shape of a hollow, generally cylindrical form. There are twenty six equilateral triangles as measured in the direction of the equilateral triangles of FIG. 1 designated 24, 22, 32, 34 and 46, whereby the total length of the geometric device, if it were in closed form, would be 13 feet long.

And, there are 36 identical equilateral triangles as measured in the direction of the identical equilateral triangles 32, 30 and 38 which direction is at right angles to the direction of the triangles 24, 22, 32, 34 and 46. The total length of these 36 triangles of the geometric device, if it were in closed form, would be 31 feet, inasmuch as the altitude of the triangle would determine its total effective length, rather than its side, or slant height. Thus, the geometric device, if it were to be measured in its closed form, as illustrated in FIG. 1, would be about 13 feet by about 31 feet. In its expanded form, the geometric device measures about 20 feet (which would be the approximate height of the barrel-like cylinder with the bulging sides) by about 55 feet (which would be the approximate circumference of the barrel-like cylinder with the bulging sides, as measured at the point of maximum girth, or a diameter of about 18.3 feet, again as measured at the point of maximum girth).

The central portion and its bulging side configuration is illustrated in FIG. 13 and it is to be appreciated that the three-cornered, three-legged, star-shaped hexagons are more expanded and are larger in area at the point of maximum girth and that they grow more sharp and thinner and smaller in area as you approach the ends thereof. The top portion of the egg is slightly smaller and is less rounded than the bottom end portion which is slightly larger and more rounded. Such portions are then fabricated and constructed and are then carefully fitted into and meshed with the central cylindrical section. All portions of the geometric device start with triangles having sides of 1 foot each.

This brings the total overall length of the egg, that is, the length as measured from one pole to the other pole to about 25.7 feet. The maximum width or girth, as measured at the point of the greatest bulge, remains at about 18.3 feet, for a total circumference thereat of about just under 55 feet.

The identical equilateral triangles and the three-cornered star-shaped equilateral hexagons are bolted and joined together in a smooth curve at the lines of intersection in coextensive alignment and the shape of the egg is excellent.

A total number of 1104 identical equilateral triangles (one foot to a side) and a total number of 524 three-cornered, three-legged, star-shaped equilateral hexagons also with sides of one foot each are fabricated and are visible on the exterior of the surface of the egg. The skin of the egg is made of aluminum, with the equilateral triangles having a thickness of about ⅛ inch and the three-legged star-shaped equilateral hexagons having a thickness of about 1/16 inch.

EXAMPLE II

The principles of the present inventive concept are equally applicable to the design, fabrication, and construction of other surfaces, such as a hyperbolic paraboloidal surface, such as is illustrated in FIG. 12 of the drawings.

The geometric device to be used is the form shown in the FIGS. 1–4 having identical equilateral triangles which, upon rotation and expansion of the geometric device create three cornered, three-legged star-shaped equilateral hexagons having sides which are equal to the sides of the equilateral triangles. The geometric device is fitted easily to the compound curves of the hyperbolic paraboloidal surface.

Careful precise measurements are taken of the individual positioning and relationship of the plurality of equilateral triangles, as well as the individual positioning and relationship of the star-shaped hexagons. These precise measurements are then calculated and scaled upwardly and the full scale structural elements are then fabricated from such measurements accordingly. The fabricated elements are then fitted together and are joined together in coextensive alignment, as illustrated in FIG. 12, in which their collective areas or surfaces create the desired hyperbolic paraboloidal curved surface.

Although several specific Examples of the invention have now been described in particularity, the same should not be construed as limiting the broader aspects of the invention thereto or to the specific materials or procedures mentioned therein. The invention may include various other materials or procedures, as well as other equivalent features, as set forth in the claims appended hereto. It is understood that any suitable or reasonable changes, modifications, or variations may be made, without departing from the scope and the spirit of the broader aspects of the present inventive concept.

What is claimed is:

1. A self-supporting structural unit having a polygonal, non-planar surface in three dimensions approximating a smooth, predefined, non-planar, analytical surface in three dimensions, said polygonal, non-planar surface comprising: a first plurality of identical, individually fabricated and constructed planar polygons having predefined and fixed areas and equal sides of a predetermined fixed length; and a second plurality of individually fabricated and constructed substantially planar polygons having various areas with respect to themselves and equal sides of a predetermined length, the sides of said first plurality of identical, individually fabricated and constructed planar polygons being equal in length to the sides of said second plurality of individually fabricated and constructed substantially planar polygons and being secured together with their sides in coextensive alignment, all the vertices of said first and said second pluralities of individually fabricated and constructed polygons lying substantially in the smooth, predefined, non-planar, analytical surface in three dimensions and with the surface areas of said first and said second pluralities of individually fabricated and constructed polygons forming the polygonal, non-planar surface in three dimensions of said self-supporting structural unit.

2. A self-supporting structural unit having a polygonal, non-planar surface in three dimensions as defined in claim 1, wherein said first plurality of identical, individually fabricated and constructed planar polygons comprises equilateral triangles and said second plurality of individually fabricated and constructed substantially planar polygons comprises equilateral hexagons.

3. A self-supporting structural unit having a polygonal, non-planar surface in three dimensions as defined in claim 1, wherein said first plurality of identical, individually fabricated and constructed planar polygons comprises quadrilaterals and said second plurality of individually fabricated and constructed substantially planar polygons comprises quadrilaterals.

4. A self-supporting structural unit having a polygonal, non-planar surface in three dimensions as defined in claim 1, wherein said first plurality of identical, individually fabricated and constructed planar polygons comprises squares and said second plurality of individually fabricated and constructed substantially planar polygons comprises rhombuses.

5. A self-supporting structural unit having a polygonal, non-planar surface in three dimensions as defined in claim 1, wherein said first plurality of identical, individually fabricated and constructed planar polygons comprises rhombuses and said second plurality of individually fabricated and constructed substantially planar polygons comprises rhombuses.

6. A self-supporting structural unit having a polygonal, non-planar surface in three dimensions as defined in claim 1, wherein said first plurality of identical, individually fabricated and constructed planar polygons comprises equilateral, equiangular hexagons and said second plurality of individually fabricated and constructed substantially planar polygons comprises equilateral, equiangular hexagons.

7. A self-supporting structural unit having a polygonal, non-planar surface in three dimensions as defined in claim 1, wherein said smooth, predefined, non-planar, analytical surface in three dimensions is a non-developable surface.

8. A self-supporting structural unit having a polygonal, non-planar surface in three dimensions as defined in claim 1, wherein said smooth, predefined, non-planar, analytical surface in three dimensions is a hyperbolic paraboloidal surface.

9. A self-supporting structural unit having a polygonal, non-planar surface in three dimensions as defined in claim 1, wherein said smooth, predefined, non-planar, analytical surface in three dimensions is the surface of a closed, solid geometric figure.

10. A self-supporting structural unit having a polygonal, non-planar surface in three dimensions as defined in claim 1, wherein said smooth, predefined, non-planar, analytical surface in three dimensions is an ovoidal solid figure.

11. A self-supporting structural unit having a polygonal, non-planar surface in three dimensions as defined in claim 1, wherein said smooth, predefined, non-planar, analytical surface in three dimensions is the surface of an egg.

12. A self-supporting structural unit having a polygonal, non-planar surface in three dimensions as defined in claim 1, wherein said pluralities of polygons are made of aluminum.

13. A self-supporting structural unit having a polygonal, non-planar surface in three dimensions as deined in claim 1, wherein said smooth, predefined, non-planar, analytical surface in three dimensions is the hull of a ship.

* * * * *